US006790093B2

(12) United States Patent
Tanaka et al.

(10) Patent No.: US 6,790,093 B2
(45) Date of Patent: Sep. 14, 2004

(54) CONNECTOR APPARATUS FOR SWITCH

(75) Inventors: Nobuyoshi Tanaka, Yokkaichi (JP); Kiyofumi Ichida, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/417,224

(22) Filed: Apr. 17, 2003

(65) Prior Publication Data

US 2003/0228784 A1 Dec. 11, 2003

(30) Foreign Application Priority Data

May 14, 2002 (JP) ..... 2002-138893

(51) Int. Cl.[7] ..... H01R 25/00
(52) U.S. Cl. ..... 439/651; 439/218; 439/224
(58) Field of Search ..... 439/651, 638, 439/218, 224

(56) References Cited

U.S. PATENT DOCUMENTS 5,971,784 A * 10/1999 Fabian et al. ..... 439/224
6,109,952 A * 8/2000 Jaag ..... 439/441
6,386,921 B1 * 5/2002 Casari ..... 439/651
6,416,362 B1 * 7/2002 Conrad et al. ..... 439/651
6,500,025 B1 * 12/2002 Moenkhaus et al. ..... 439/502

FOREIGN PATENT DOCUMENTS

JP 6-111655 4/1994

* cited by examiner

*Primary Examiner*—Gary Paumen
(74) *Attorney, Agent, or Firm*—Banner & Witcoff, Ltd.

(57) ABSTRACT

Selectively mounted on a mounting concavity (13) of a switch-side connector (10) having a switch terminal (14) projected therefrom is a first attachment (40) having a connector fit-on part (41) and a terminal insertion part (42) disposed orthogonally to the connector fit-on part (41) or a second attachment (50) having a connector fit-on part (51) and a terminal insertion part (52) disposed in an approximately straight line. By fitting a mating electric wire-side connector on the connector fit-on part (41) of the first attachment (40), an electric wire can be pulled out in the shape of a letter "L" from the switch-side connector (10). By fitting the electric wire-side connector on the connector fit-on part (51) of the second attachment (50), the electric wire can be pulled out upward and straight from the switch-side connector (10).

8 Claims, 20 Drawing Sheets

10: switch-side connector
13: mounting concavity
14: switch terminal
40: first attachment
41: connector fit-on part
42: terminal insertion part
50: second attachment
51: connector fit-on part
52: terminal insertion part 10: switch-side connector 13: mounting concavity 14: switch terminal 40: first attachment 41: connector fit-on part 42: terminal insertion part 50: second attachment 51: connector fit-on part 52: terminal insertion part FIG. 16
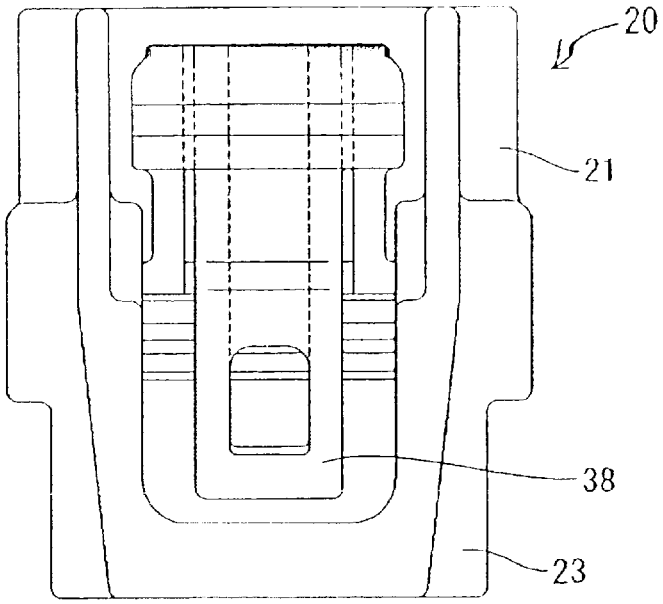
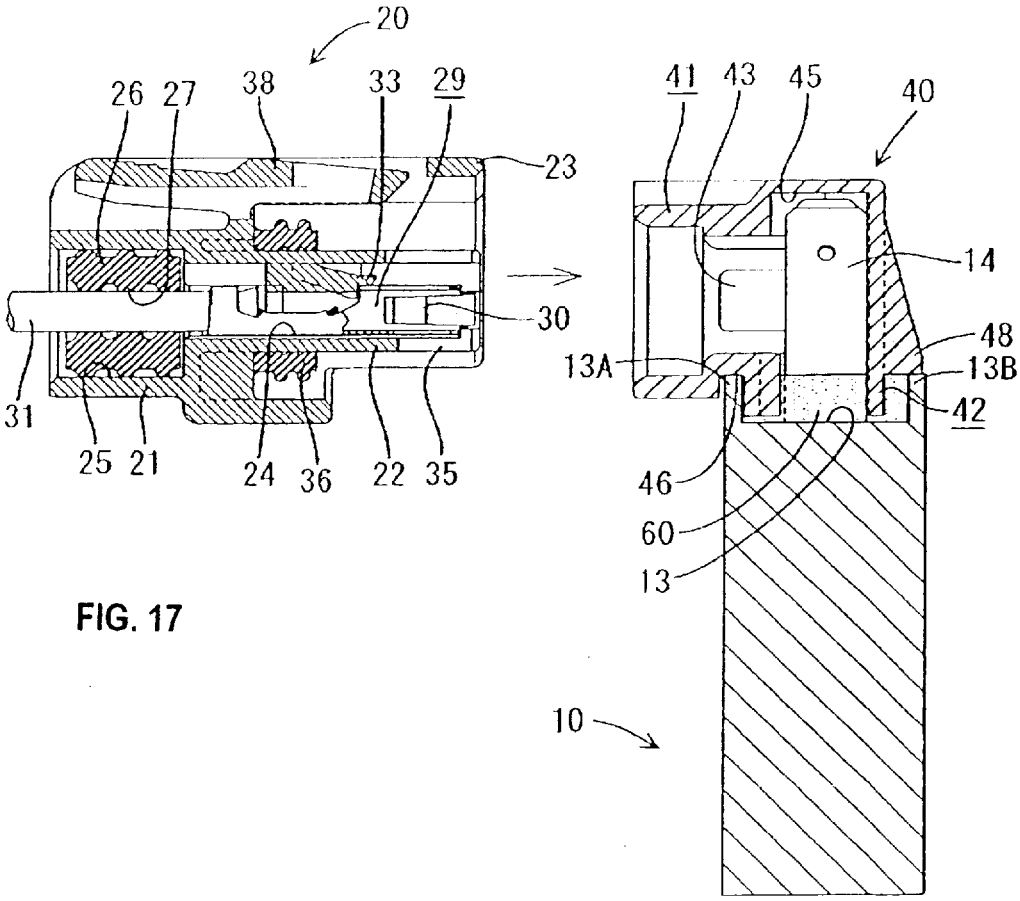
FIG. 17

CONNECTOR APPARATUS FOR SWITCH

FIELD OF THE INVENTION

The present invention relates to a connector apparatus for a switch.

DESCRIPTION OF THE RELATED ART

In the past, a lead wire was pulled or directed out of a switch, such as a microswitch, in the manner as the disclosed in Japanese Patent Application Laid-Open No. 6-111655. The switch construction has a switch-side connector having a switch mechanism and a switch terminal projecting therefrom. An electric wire-side connector having a connector terminal is mounted to a terminal of the lead wire. The electric wire-side connector is fit onto the switch terminal of the switch-side connector to connect the switch terminal and the connector terminal to each other. In this way, the lead wire is pulled or directed out of the switch.

However, in the above-described conventional switch construction, the direction in which the lead wire is directed out of the switch-side connector is limited to the projected direction of the switch terminal. Therefore, the use of a switch-side connector is limited based on the situation. For example, the switch-side connector cannot be installed, if a sufficient space cannot be secured in the above-described direction. Thus there is a demand for improvement of the switch construction.

SUMMARY OF THE INVENTION

The present invention has been made in view of the above-described situation. Thus it is an object of the present invention to allow the direction in which an electric wire is pulled out of a switch-side connector to be varied.

To achieve the object, there is provided a connector apparatus for a switch comprising: a switch-side connector having a switch mechanism and a switch terminal projecting therefrom; an electric wire-side connector having a connector terminal connectable to the switch terminal and installed on a terminal of an electric wire; a first attachment having a terminal insertion part into which the switch terminal can be inserted and a connector fit-on part on which the electric wire-side connector is capable of fitting, with the switch terminal being inserted into the connector fit-on part and with the connector fit-on part and the terminal insertion part disposed approximately orthogonally to each other; and a second attachment having a terminal insertion part and a connector fit-on part, with the terminal insertion part and the connector fit-on part disposed in an approximately straight line. The first attachment and the second attachment are interchangeable and selectively mounted on the switch-side connector.

Preferably, the switch-side connector can be provided, for example, vertically in plural numbers in such a way that the switch-side connectors can be connected to each other.

According to the present invention, the first attachment and the second attachment are selectively mounted on the switch-side connector, and the electric wire-side connector is fit onto the first attachment or the second attachment. In the case where the first attachment is mounted on the switch-side connector, an electric wire can be pulled out or directed in a direction approximately orthogonal to a pull-out position of the switch-side connector. That is, the electric wire can be directed in the shape of a letter "L" relative to the switch-side connector. In the case where the second attachment is mounted on the switch-side connector, the electric wire can be directed almost straight from the pull-out position of the switch-side connector. Therefore, the pull-out direction of the electric wire can be easily altered from the L shape to the straight shape and vice versa.

In the case where a plurality of the switch-side connectors are provided, it is possible to effectively utilize the space by directing the electric wire out of the switch-side connector in the shape of "L" and/or a straight shape.

BRIEF DESCRIPTION OF THE DRAWINGS

FIG. 16 is a plan view showing the housing of the electric wire-side connector.

FIG. 17 is a side sectional view showing an operation of fitting the electric wire-side connector on the first attachment.

DETAILED DESCRIPTION OF THE PREFERRED EMBODIMENTS

A connector apparatus for a switch according to an embodiment of the present invention will be described below with reference to FIGS. 1 through 25.

Figure 1:
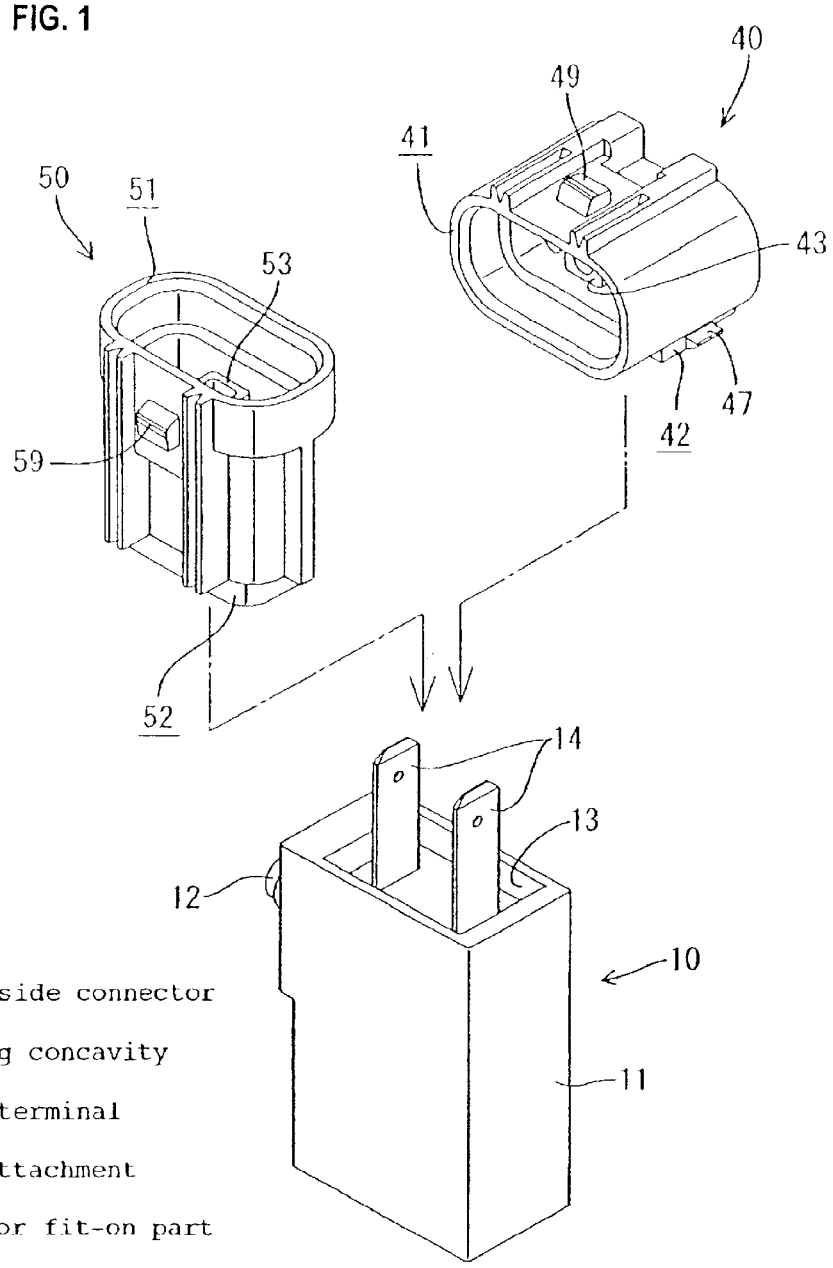
FIG. 1 is a perspective view showing a switch-side connector and first and second attachments according to an embodiment of the present invention.

In the disclosed embodiment, as an example, the connector apparatus is applied to a stop lamp switch of a two-wheeled vehicle. As shown in FIG. 1, the connector apparatus has a switch-side connector 10, a first attachment 40 and a second attachment 50 that can be selectively and interchangeably installed on the switch-side connector 10 to effect coupling with an electric wire-side connector 20 (see FIG. 17).

Figure 2:
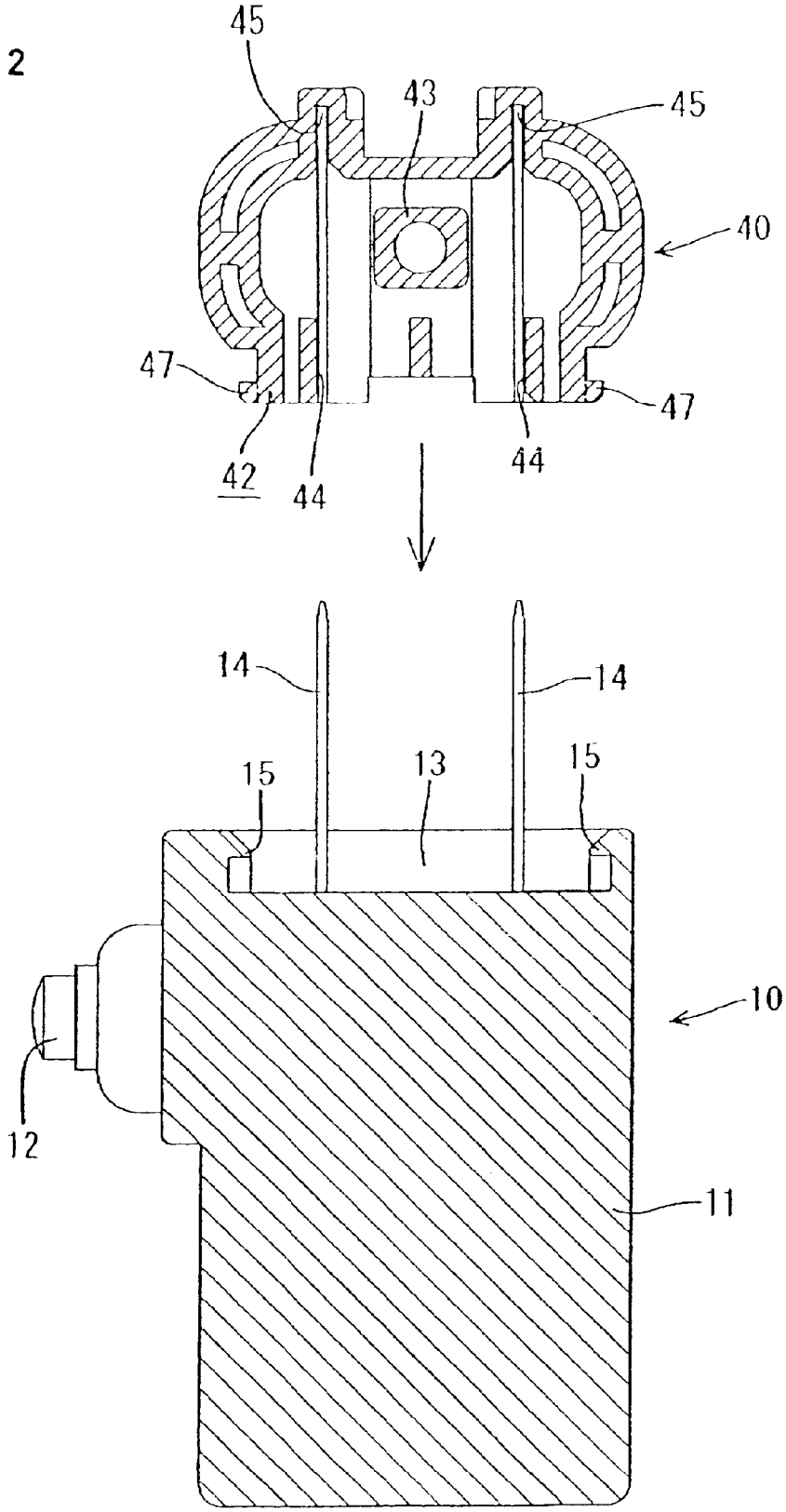
FIG. 2 is a front sectional view showing an operation of mounting the first attachment on the switch-side connector.
Figure 3:
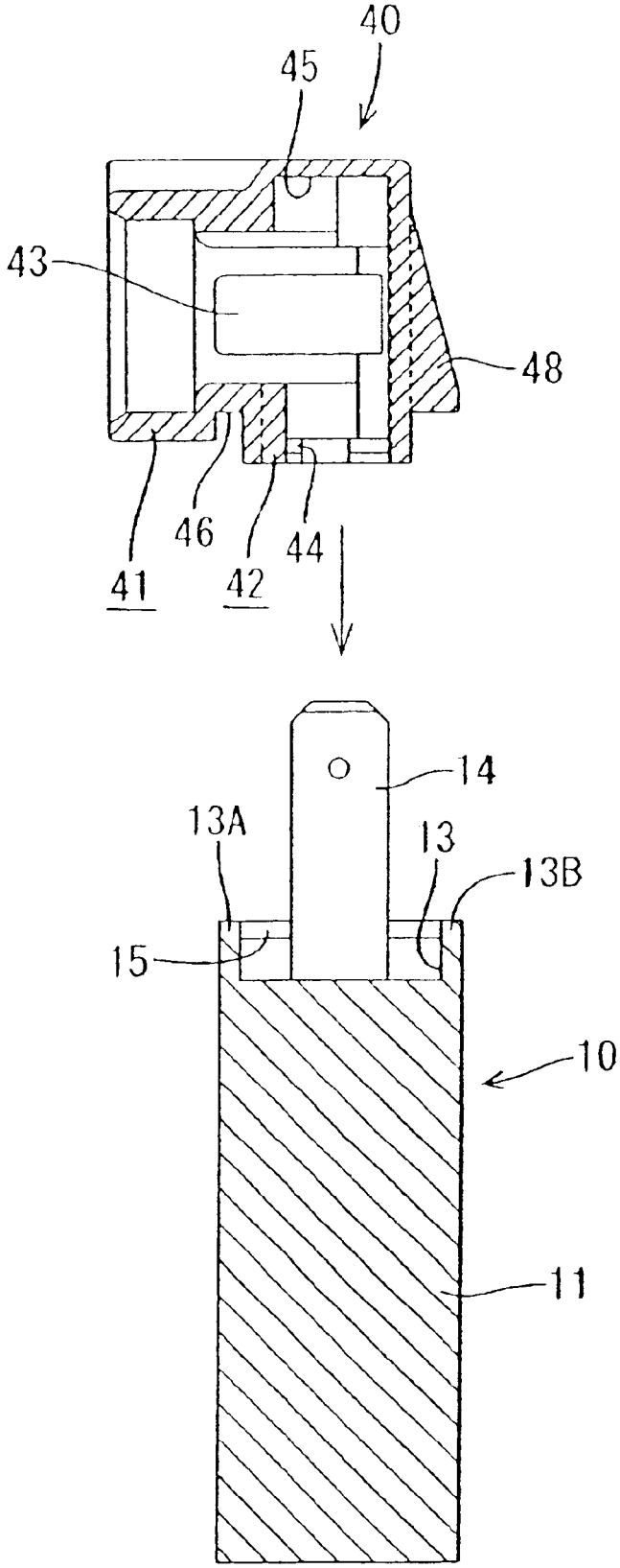
FIG. 3 is a side sectional view showing the operation of mounting the first attachment on the switch-side connector.

As shown in FIGS. 2 and 3, in the switch-side connector 10, a switch mechanism is embedded in a rectangular solid-shaped housing 11 formed by molding a synthetic resinous material. An actuator 12 constituting a switch projects from an upper end of one side surface of the housing 11. A mounting concavity 13 for mounting the first attachment 40 and the second attachment 50 therein is formed on the upper end surface of the housing 11.

A pair of tab-shaped switch terminals 14 project parallel with each other from a bottom surface of the mounting concavity 13. As shown in FIG. 2, a hooking part 15 is formed at the upper end of each of opposed shorter-side peripheral walls of the mounting concavity 13.

The electric wire-side connector 20 will be described below with reference to FIGS. 15 through 18. The electric wire-side connector 20 is waterproof and has a housing 21 made of a synthetic resinous material. The housing 21 is generally oblong. A tower part 22, that is a little smaller than the housing 21, is formed at the front side of the housing 21. A hood part 23 is formed around the tower part 22. Two cavities 24 extend inside the housing 21 in its longitudinal direction, with the cavities 24 spaced at a regular interval in the widthwise direction of the housing 21. A mounting hole 25 is formed in the rear surface of the housing 21, with the mounting hole 25 extending to the entrance of both cavities 24. A waterproof rubber plug 26 of a batch type is fit into the mounting hole 25.

Figure 18:
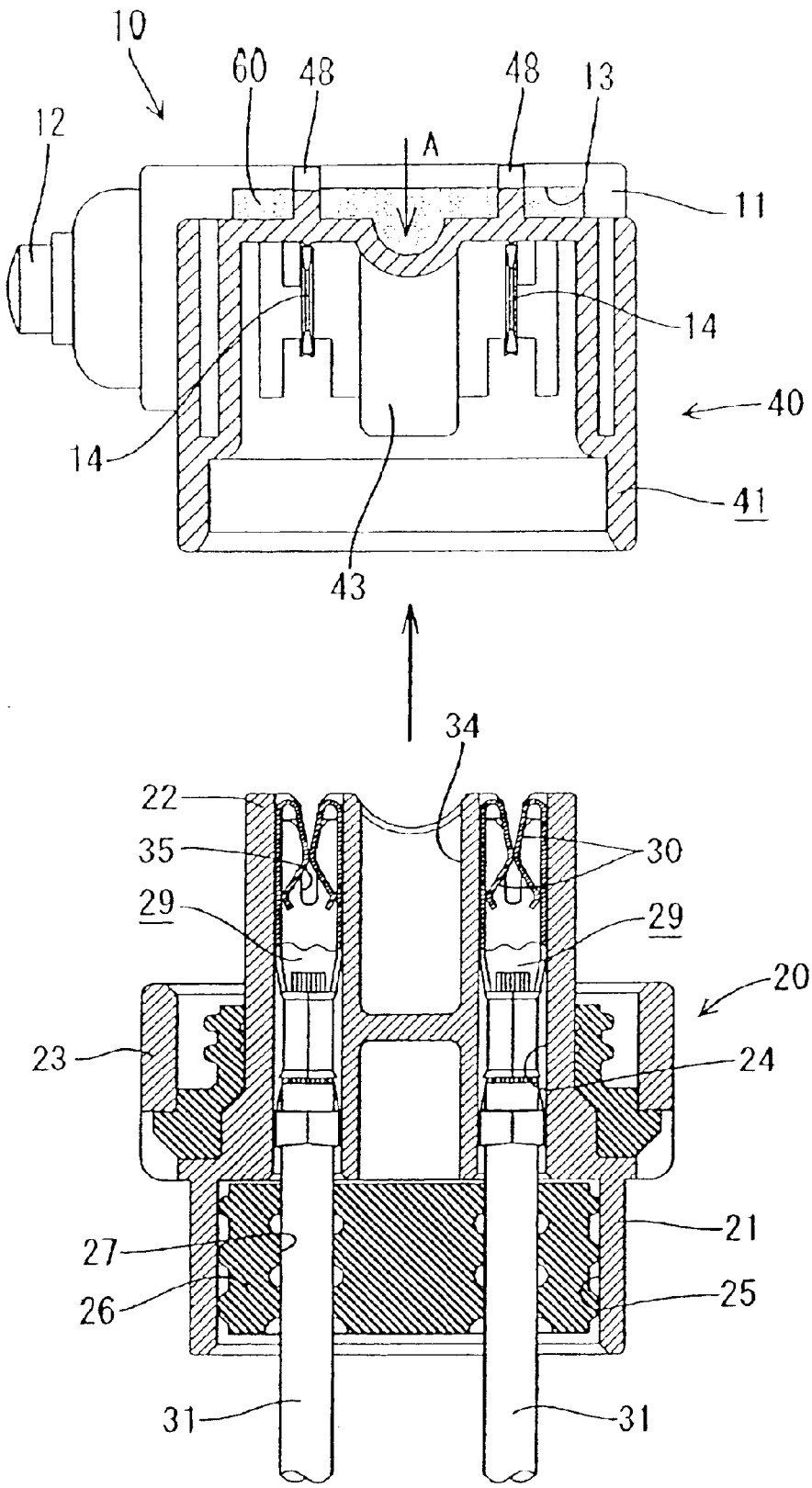
FIG. 18 is a plan sectional view showing the operation of fitting the electric wire-side connector on the first attachment.

A connector terminal 29 is accommodated in each of the cavities 24 of the housing 21. The connector terminal 29 is of a Faston type. As shown in FIG. 18, each connector terminal 29 has a pair of elastic contact pieces 30 folded inward at an upper end thereof, with the elastic contact pieces 30 opposed to each other. Each switch terminal 14 is inserted between a pair of the elastic contact pieces 30 so as to be sandwiched elastically therebetween. In this way, the switch terminals 14 contact the connector terminals 29 that are crimped to a terminal of an electric wire 31, which is a lead wire.

With a pair of the elastic contact pieces 30 disposed at the right-hand side and the left-hand side in a front view, the connector terminals 29 are inserted into the corresponding cavities 24 from the rear side thereof through an electric wire insertion hole 27 in the waterproof rubber plug 26 and locked in housing 21 by a lance 33 formed on a ceiling surface of the cavity 24. Thus it is possible to prevent the connector terminals 29 accommodated in the cavities 24 from being separated from the cavities 24.

Figure 15:
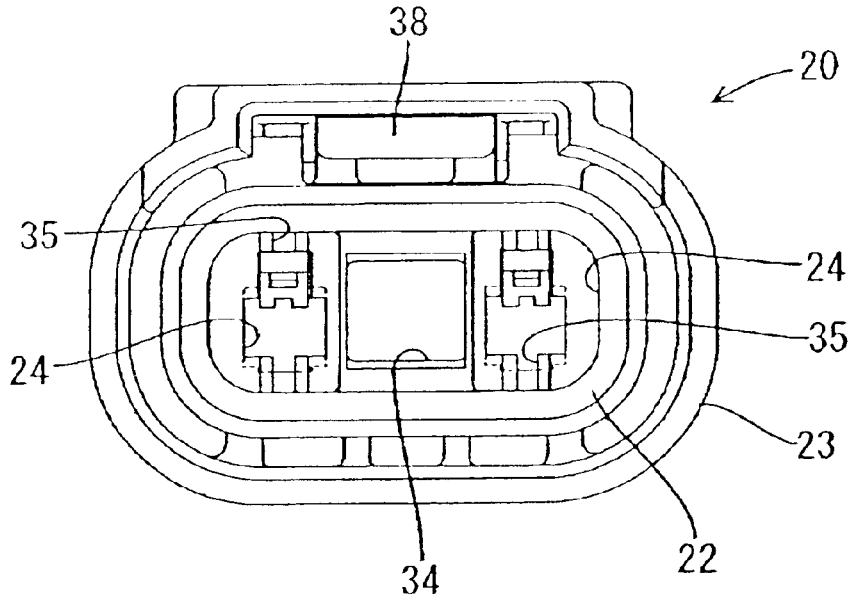
FIG. 15 is a front view showing a housing of the electric wire-side connector.

As shown in FIGS. 15 and 18, a guide hole 34 is formed from the front surface of the tower part 22 to the rear of the housing 21 at a position between cavities 24. At the front side of the each cavity 24, a vertical groove 35 (i.e., transverse to cavity 24) extends rearward in a predetermined dimension, with the vertical groove 35 extending from the ceiling wall to and through the bottom wall of the cavity 24. As will be described later, a switch terminal 14 is capable of penetrating into each vertical groove 35.

As shown in FIG. 17, a waterproof packing 36 is fit onto the periphery of the tower part 22 at its root end. As shown in FIGS. 16 and 17, a locking arm 38 of a seesaw type is formed on the upper surface of the housing 11.

The first attachment 40 will be described below with reference to FIGS. 1 through 7. The first attachment 40 is L-shaped and made of a synthetic resinous material. The first attachment 40 has a connector fit-on part 41 disposed on its front end and a terminal insertion part 42 on its bottom end, with the connector fit-on part 41 and the terminal insertion part 42 disposed orthogonally to each other.

The tower part 22 of the electric wire-side connector 20 can be fit into the connector fit-on part 41. The entrance side of the connector fit-on part 41 is formed a little larger than other portions thereof to accommodate the waterproof packing 36. A guide cylinder 43 that can be fit into the guide hole 34 of the electric wire-side connector 20 extends forward from the rear side of the connector fit-on part 41.

Figure 6:
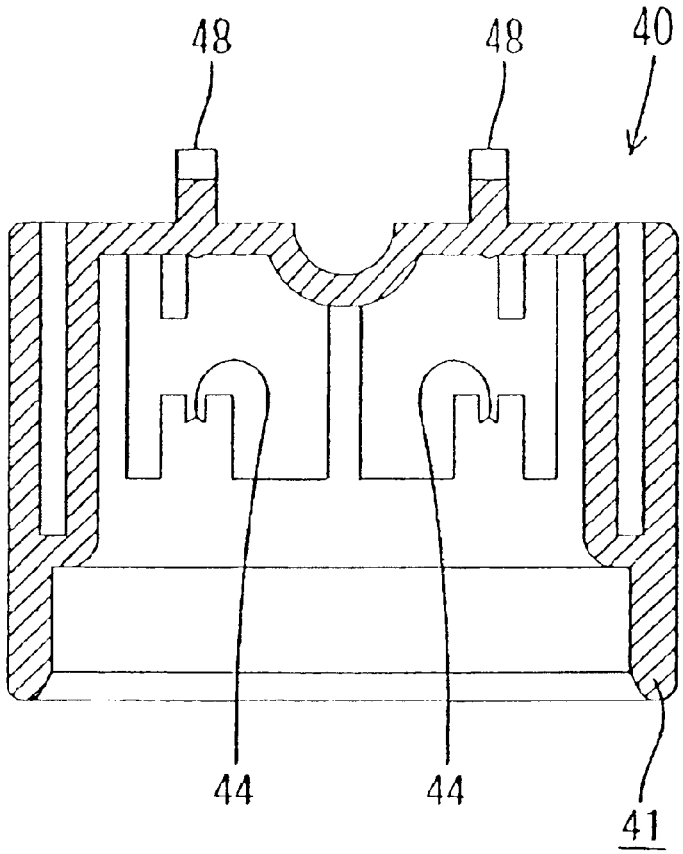
FIG. 6 is a sectional view taken along a line VI—VI of FIG. 4.
Figure 7:
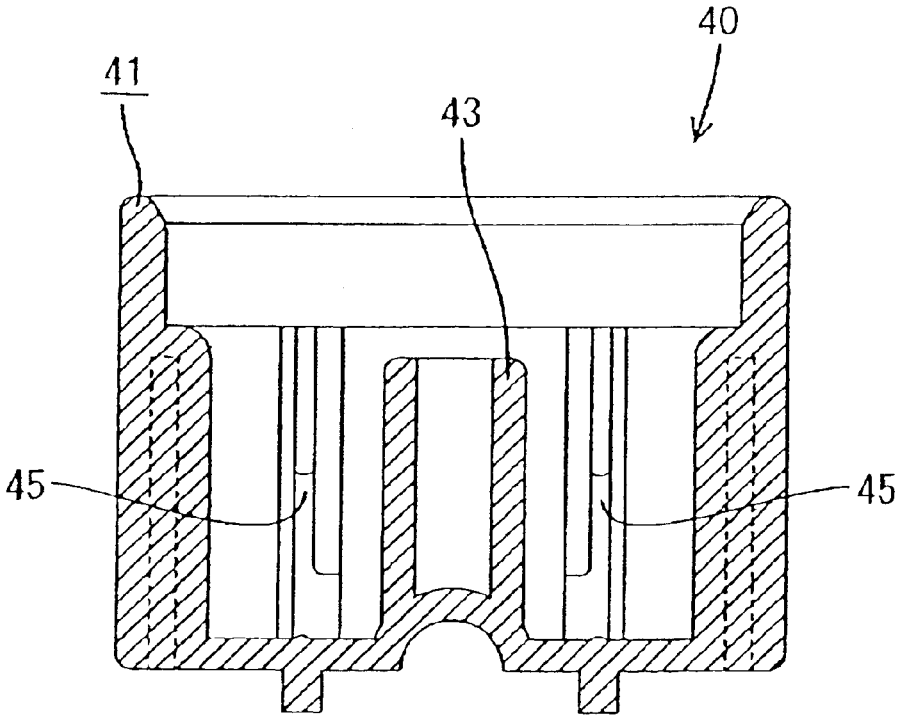
FIG. 7 is a sectional view taken along a line VII—VII of FIG. 4.

The terminal insertion part 42 has a rectangular configuration to fit inside the mounting concavity 13 of the switch-side connector 10. As shown in FIGS. 2 and 6, a pair of insertion grooves 44, into which switch terminals 14 can be inserted individually, are formed on the bottom surface of the terminal insertion part 42. As shown in FIGS. 2 and 7, insertion grooves 45 are formed in the ceiling surface of the first attachment 40. One insertion groove 45 IS disposed directly above each insertion groove 44 for holding the front ends of the switch terminals 14 that have been inserted into first attachment 40.

Figure 4:
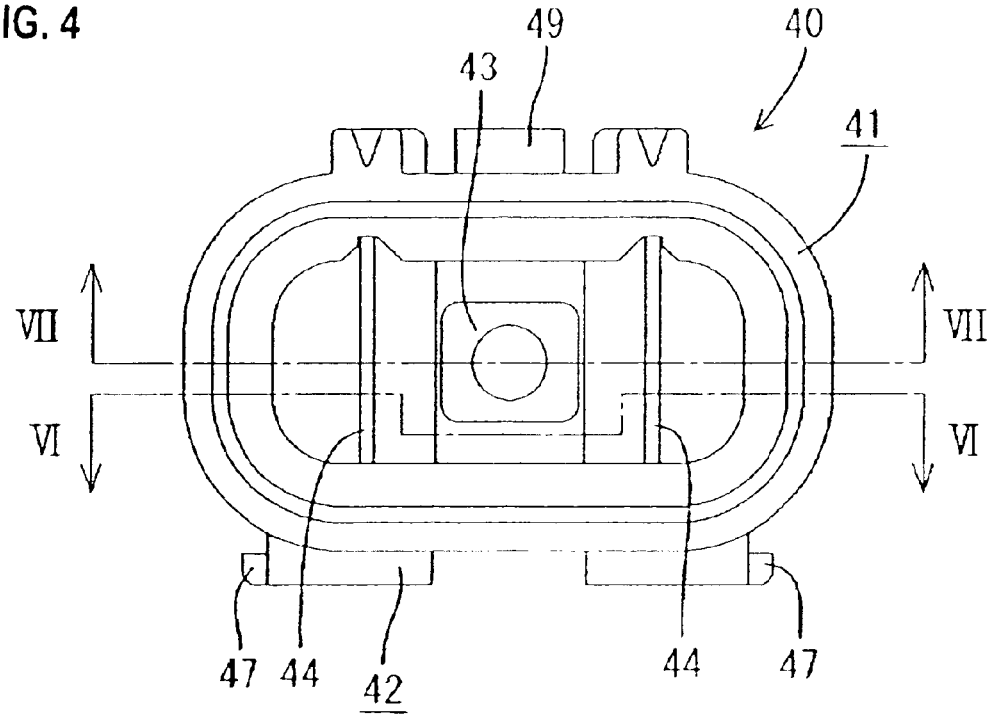
FIG. 4 is a front view showing the first attachment.
Figure 5:
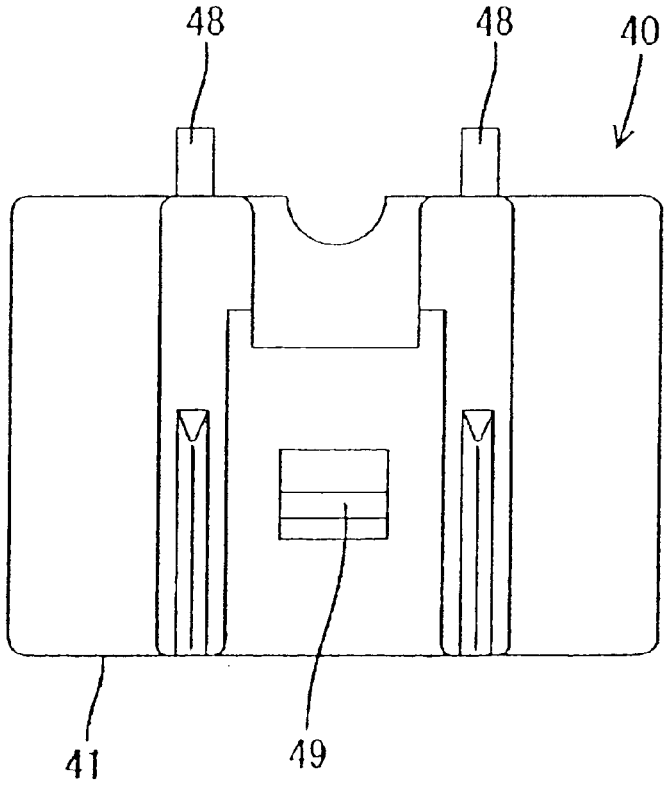
FIG. 5 is a plan view showing the first attachment.

A positioning groove 46 is formed at a forward position (left-hand side in FIG. 3) of the terminal insertion part 42 to fit on a peripheral wall 13A of the mounting concavity 13 disposed at the forward longer side. As shown in FIGS. 1, 2, and 4, a locking projection 47 is formed at the lower edge of each of the right-hand and left-hand side surfaces of the terminal insertion part 42 when the first attachment 40 is viewed from the front side.

Figure 8:
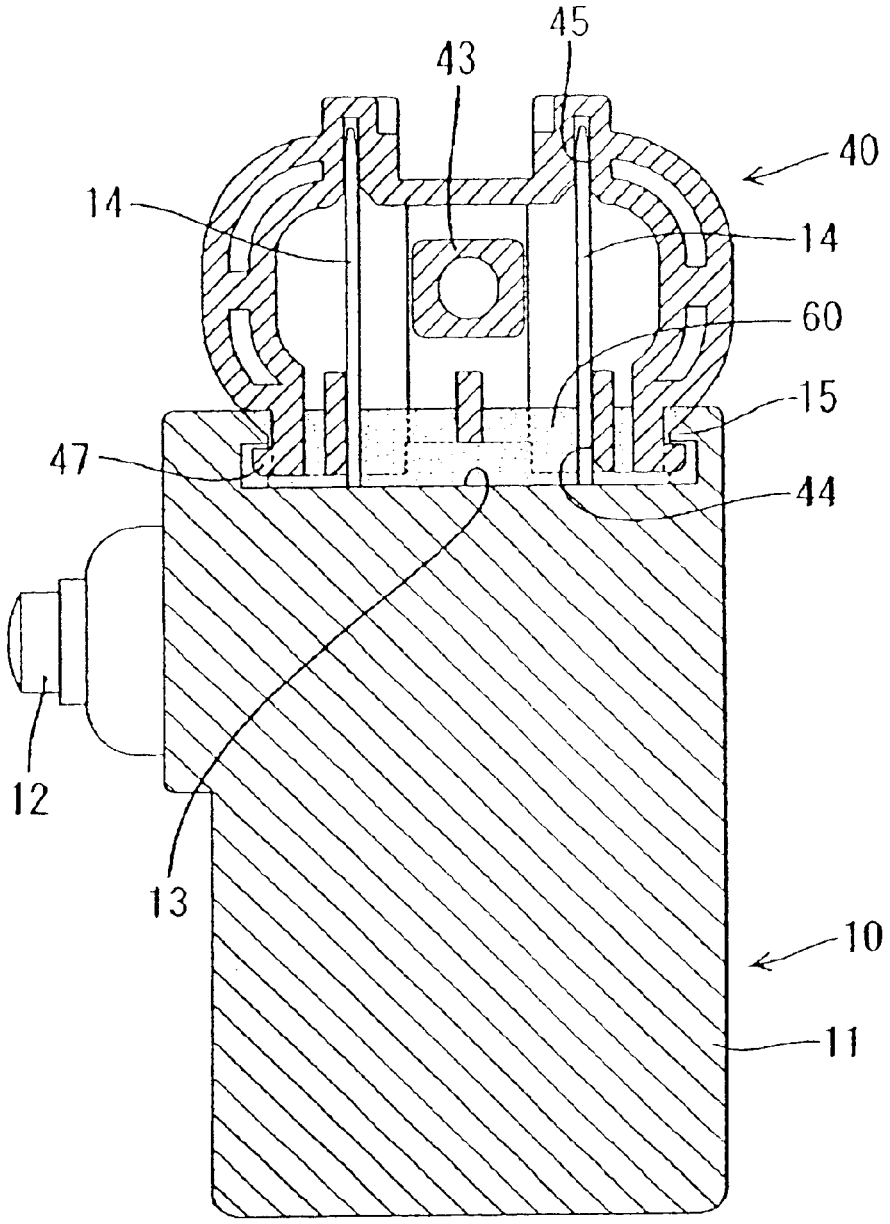
FIG. 8 is a front sectional view showing a state in which the first attachment is mounted on the switch-side connector.

As shown by the arrows in FIGS. 2 and 3, the first attachment 40 is inserted into the mounting concavity 13, with the switch terminals 14 being inserted into the insertion grooves 44. When the ceiling of the positioning groove 46 of the first attachment 40 strikes against the forward peripheral wall 13A of the mounting concavity 13 and when a stopper 48 formed on the rear surface of the first attachment 40 strikes against the rearward peripheral wall 13B, the locking projection 47 is disposed below the hooking part 15 and locked to the hooking part 15, as shown in FIGS. 8 and 17. In this way, the first attachment 40 is installed on the switch-side connector 10.

At this time, the switch terminals 14 enter and move upward relative to the first attachment 40 (i.e., toward insertion grooves 45) along the rear side of the connector fit-on part 41, until the front end of the switch terminals 14 are inserted into the insertion grooves 45. Then, as shown in FIG. 9, a pair of the switch terminals 14 are in a vertical posture along the rear side of the inside of the connector fit-on part 41, with the switch terminals 14 spaced at the predetermined interval in the right-to-left direction.

Figure 9:
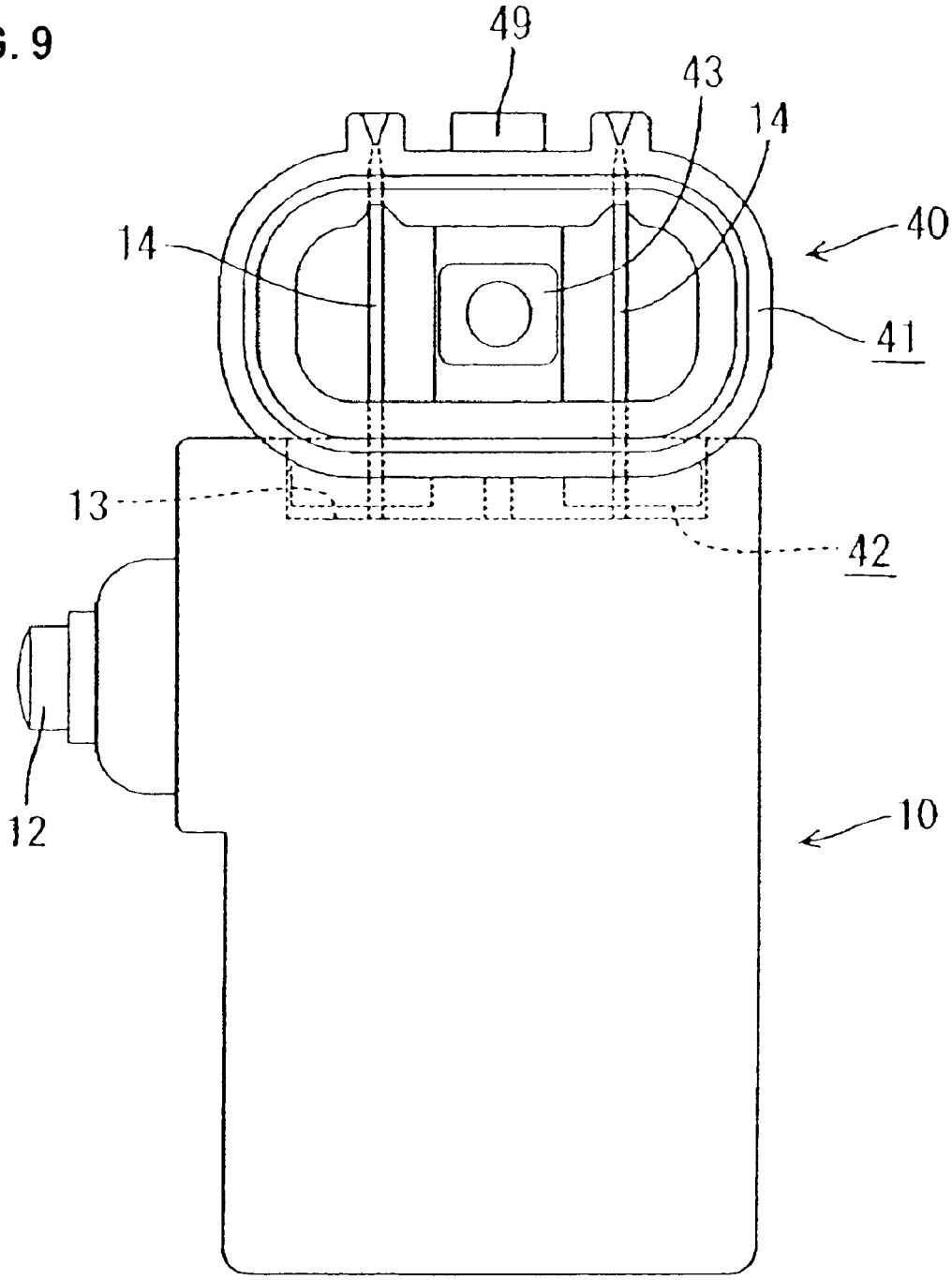
FIG. 9 is a front view showing the state in which the first attachment is mounted on the switch-side connector.

As shown in FIGS. 1 and 9, a locking projection 49 that locks to the locking arm 38 of the electric wire-side connector 20 is formed on the upper surface of the first attachment 40.

Figure 10:
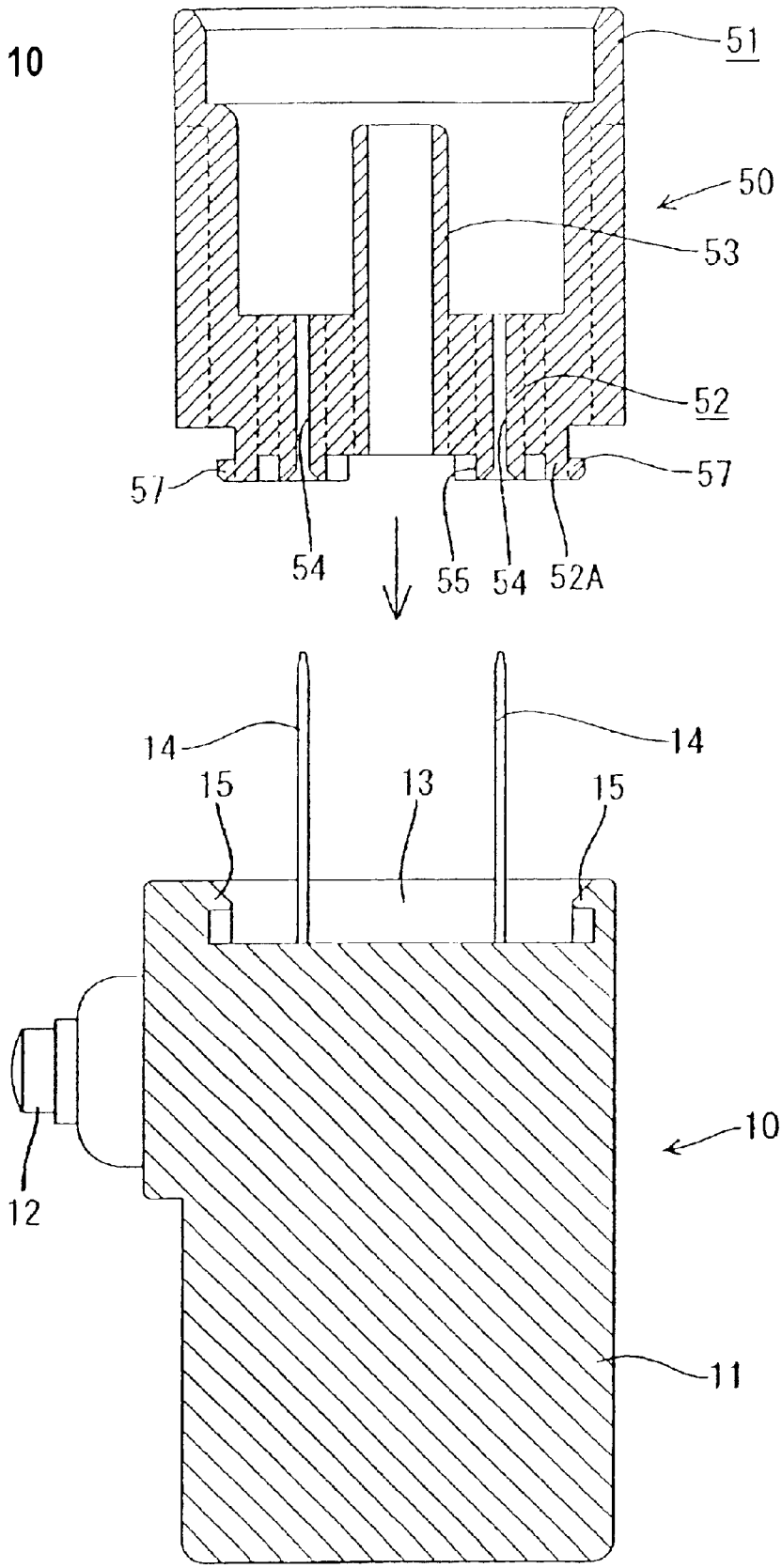
FIG. 10 is a front sectional view showing an operation of mounting the second attachment on the switch-side connector.

The second attachment 50 is described below with reference to FIGS. 1 and 10 through 13. The second attachment 50 is also made of a synthetic resinous material and is of a straight type. The second attachment 50 is generally cylindrical. As seen in FIG. 10, the second attachment 50 has a connector fit-on part 51 formed at its upper surface and a terminal insertion part 52 formed at its lower surface, with the connector fit-on part 51 and the terminal insertion part 52 disposed back-to-back on the same axis.

The tower part 22 of the electric wire-side connector 20 can be fit into the connector fit-on part 51. The entrance side (upper side in FIG. 1) of the connector fit-on part 51 is formed a little larger than the other portions thereof to accommodate the waterproof packing 36 therein. A guide cylinder 53 adapted to fit into the guide hole 34 of the electric wire-side connector 20 extends forward from the rear side of the connector fit-on part 51. As shown in FIG. 10, the hollow portion of the guide cylinder 53 is open toward an outer surface of the terminal insertion part 52.

As shown in FIG. 10, the bottom portion of the terminal insertion part 52 is formed substantially as a thick wall. A fit-in projection 52A that can be fit into the mounting concavity 13 of the switch-side connector 10 is formed on the outer surface (i.e., the lower surface in FIG. 10) of the terminal insertion part 52. A pair of insertion grooves 54 into which the switch terminals 14 can be individually inserted are formed in the terminal insertion part 52.

A locking projection 57 is formed at the lower edge of each of the right-hand and left-hand side surfaces of the fit-in projection 52A, when the second attachment 50 is viewed in the front side. An inlet passage 55 for receiving sealing material 60, including an open portion of the guide cylinder 53, is formed on the surface of the fit-in projection 52A. The sealing material 60 will be described later.

Figure 11:
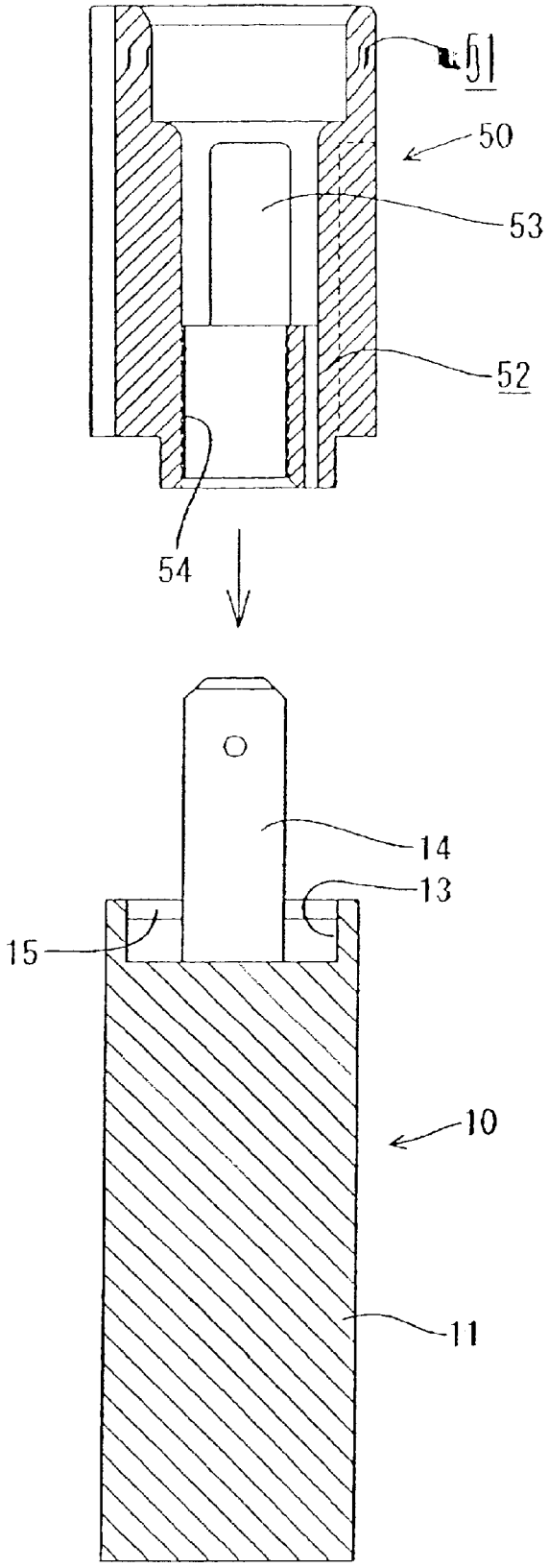
FIG. 11 is a side sectional view showing the operation of mounting the second attachment on the switch-side connector.
Figure 21:
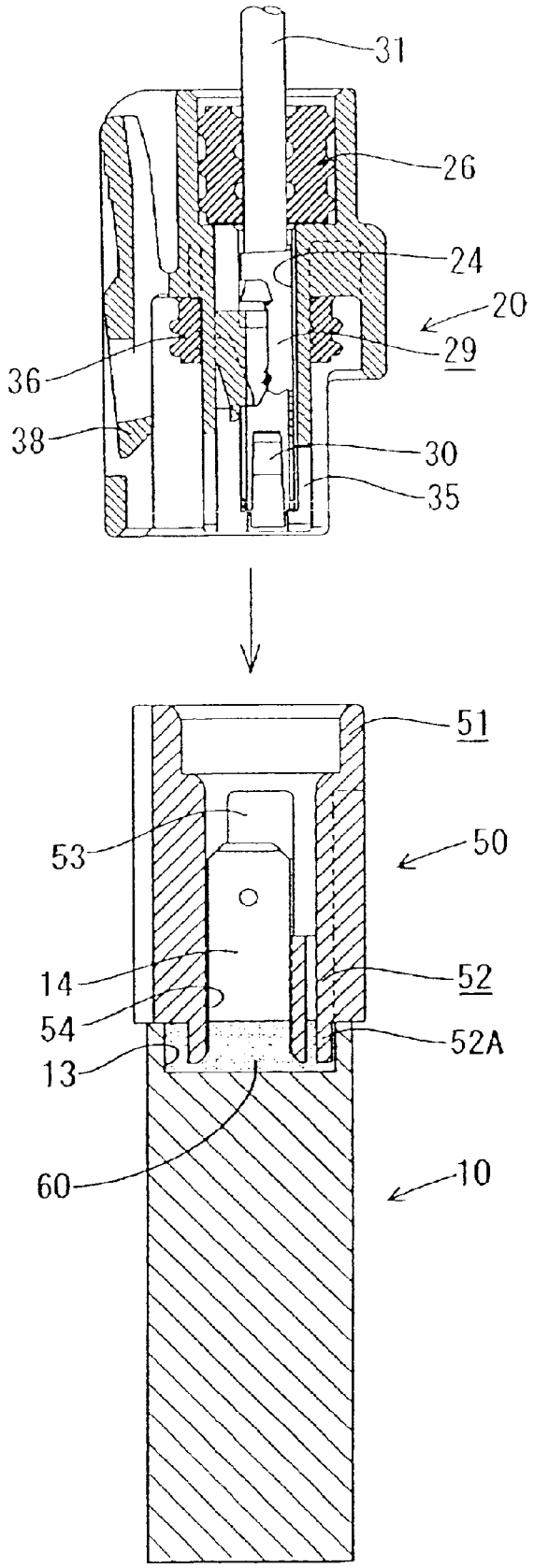
FIG. 21 is a side sectional view showing an operation of fitting the electric wire-side connector on the second attachment.

As shown by the arrows of FIGS. 10 and 11, the second attachment 50 is inserted into the mounting concavity 13, with the switch terminals 14 being inserted into the insertion grooves 54. As shown in FIG. 21, the locking projection 57 is disposed below the hooking part 15 and locked to the hooking part 15 when a surface of the terminal insertion part 52 that is disposed on the periphery of the fit-in projection 52A and stepped from the fit-in projection 52A strikes against the peripheral wall of the mounting concavity 13. Then the second attachment 50 is installed on the switch-side connector 10, as shown in FIG. 22.

Figure 14:
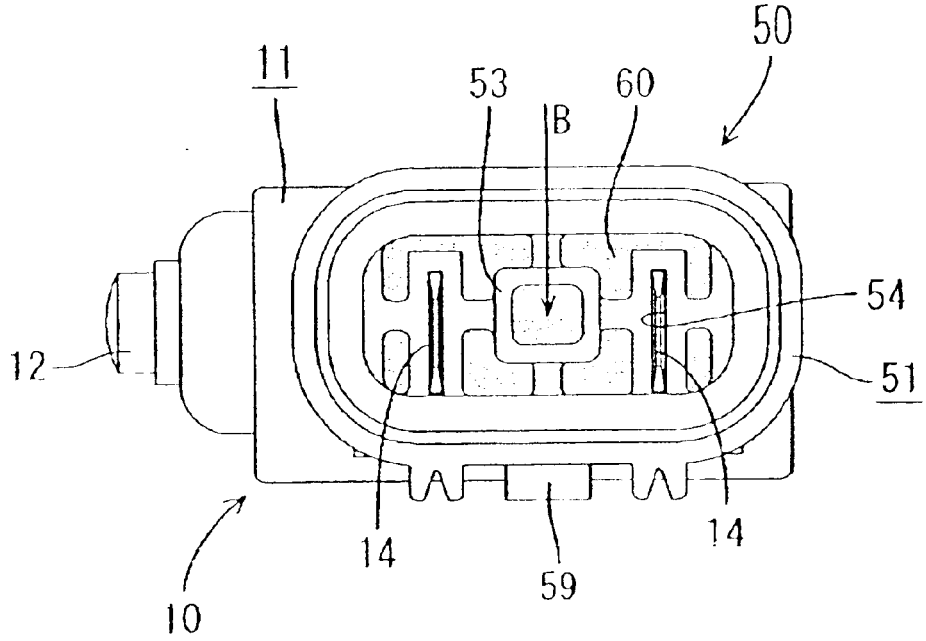
FIG. 14 is a plan view showing a state in which the second attachment is mounted on the switch-side connector.
Figure 22:
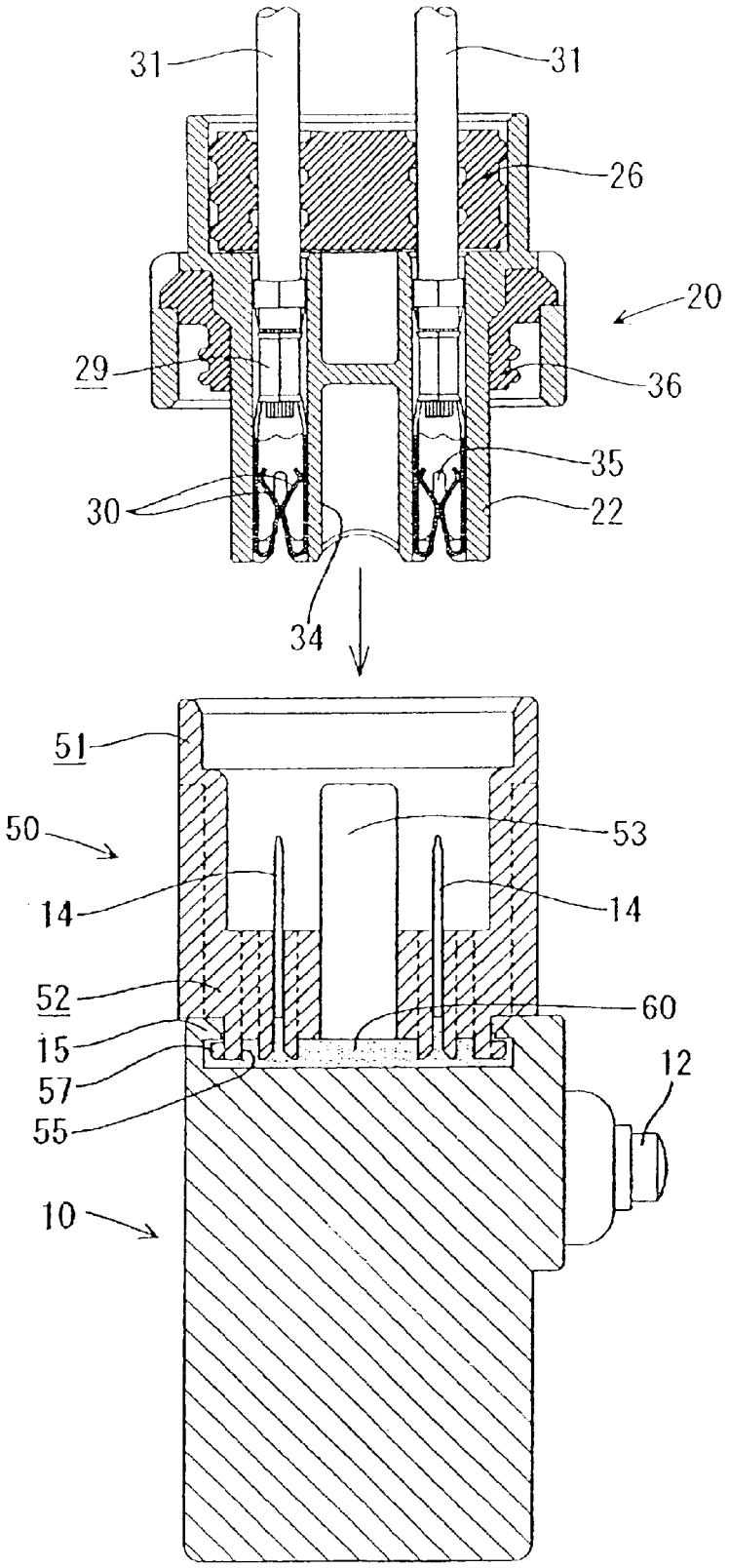
FIG. 22 is a rear sectional view showing the operation of fitting the electric wire-side connector on the second attachment.
Figure 23:
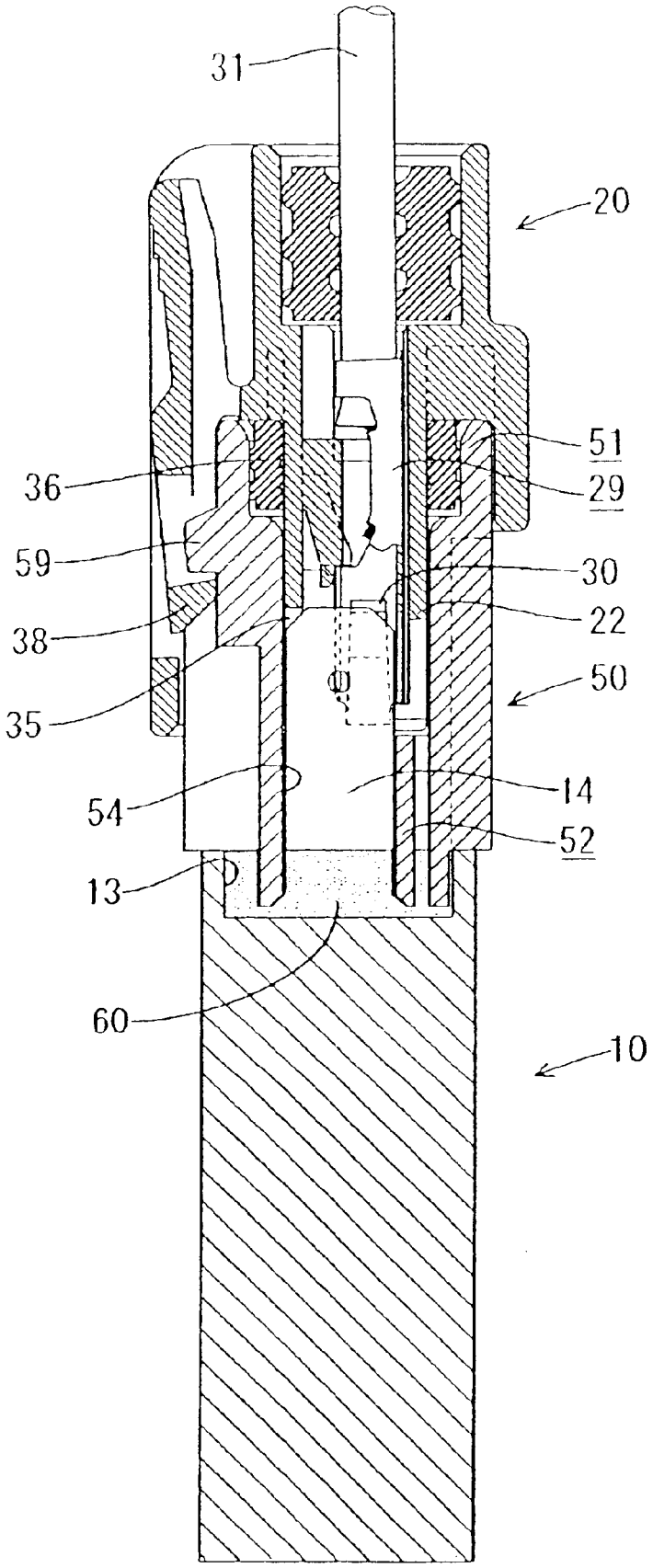
FIG. 23 is a side sectional view showing a state in which the electric wire-side connector is fit onto the second attachment.

At this time, as shown in FIGS. 14 and 22, a pair of the switch terminals 14 project into the connector fit-on part 51 from the rear surface (i.e., the bottom surface in FIG. 22) of the second attachment 50 through the corresponding insertion grooves 54.

Figure 12:
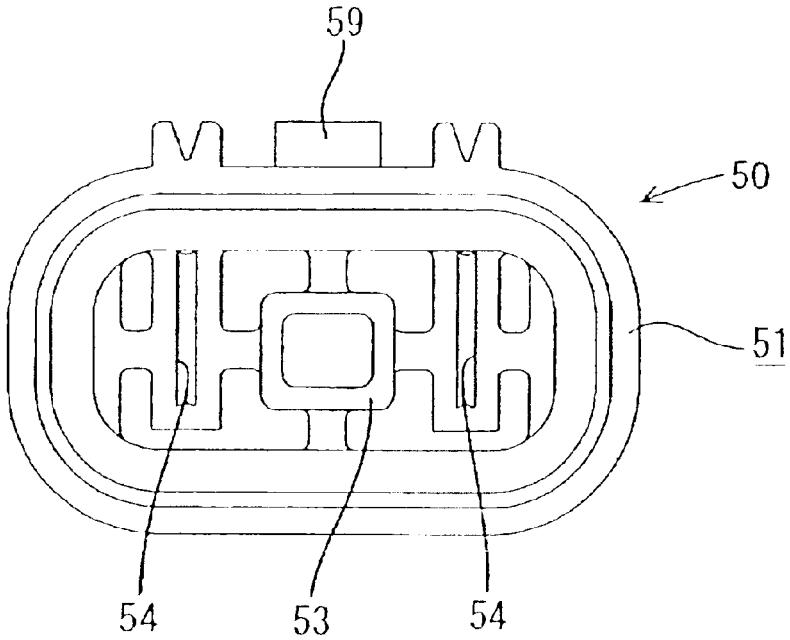
FIG. 12 is a front view showing the second attachment.
Figure 13:
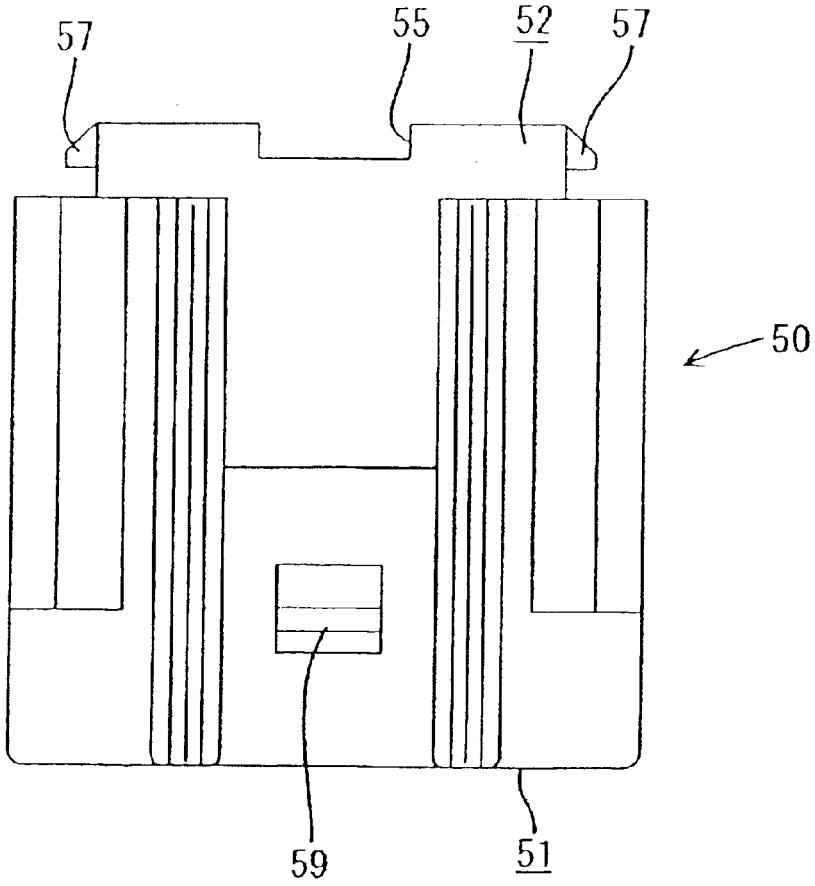
FIG. 13 is a plan view showing the second attachment.

As shown in FIGS. 1, 12, and 13, a locking projection 59 that locks to the locking arm 38 of the electric wire-side connector 20 is formed on the upper surface of the second attachment 50.

The use of the connector apparatus is described below.

When the electric wire 31 is desired to be directed in the shape of a letter "L" relative to the switch-side connector 10, the first attachment 40 is mounted on the switch-side connector 10. Briefly repeating the assembling operation, as shown with the arrows of FIGS. 2 and 3, the terminal insertion part 42 of the first attachment 40 is inserted into the mounting concavity 13. As shown in FIG. 8, the locking projection 47 is locked to the lower portion of the hooking part 15. As shown in FIG. 9, the connector fit-on part 41 of the first attachment 40 is open and faces the front, while the pair of switch terminals 14 are in a vertical posture along the rear side of the inside the connector fit-on part 41.

As shown with the arrow A of FIG. 18, the sealing material 60 is introduced into the mounting concavity 13 from the gap between the stoppers 48. As shown in FIG. 17, the first attachment 40 is firmly fixed to the switch-side connector 10, such that a projected portion of each of the switch terminals 14 is sealed with the solidified sealing material 60.

As shown by the arrows of FIGS. 17 and 18, the electric wire-side connector 20 having the locking arm 38 formed on the upper surface thereof is fit onto the connector fit-on part 41 after the first attachment 40 is fixed to the switch-side connector 10. At this time, the tower part 22 is inserted straight into the connector fit-on part 41, with the tower part 22 being guided by fitting the guide cylinder 43 in the guide hole 34. With the progress of the insertion of the tower part 22 into the connector fit-on part 41, the switch terminals 14 penetrate into the vertical grooves 35 of the cavity 24 and into a pair of the elastic contact pieces 30 of the connector terminal 29 accommodated in the cavities 24.

Figure 19:
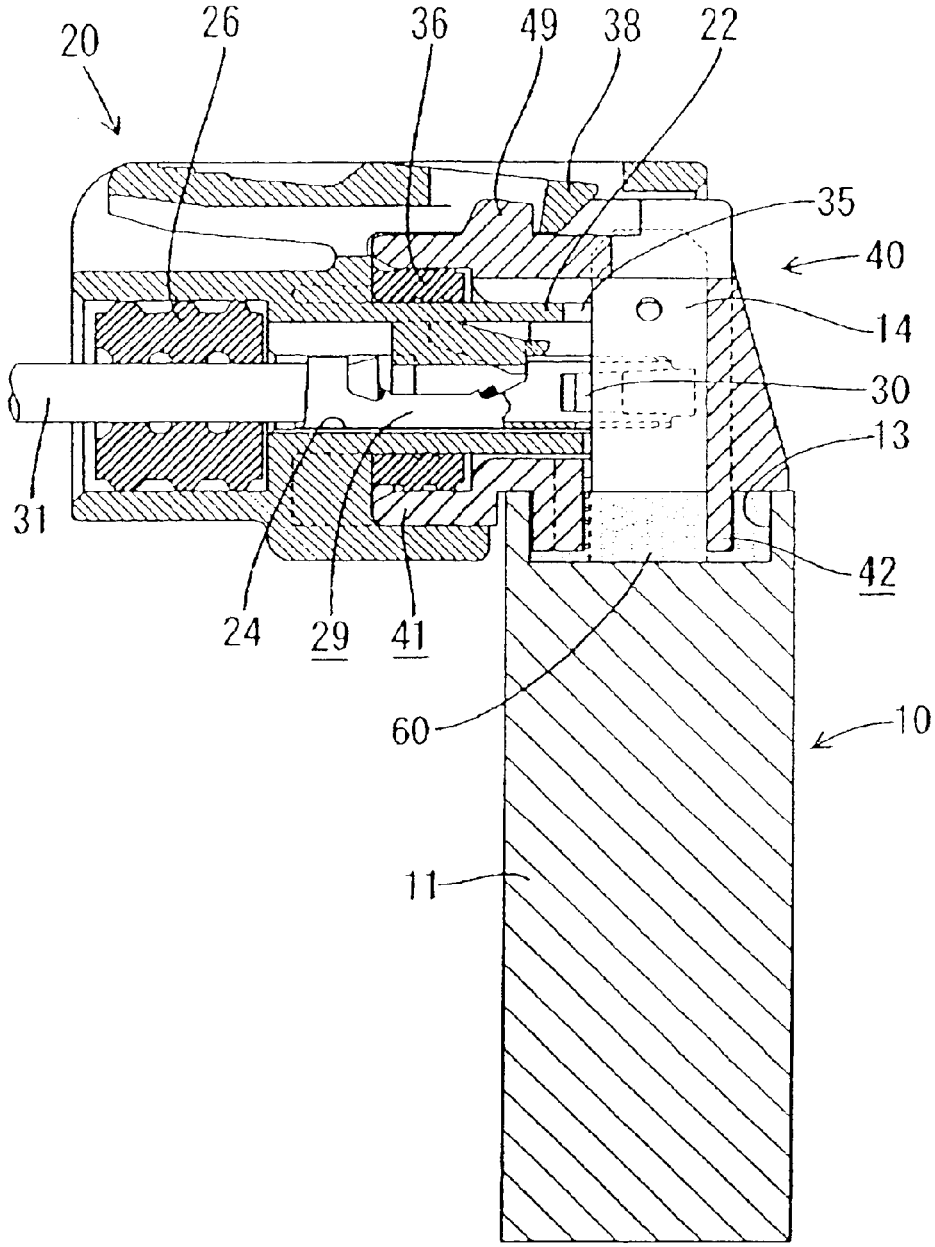
FIG. 19 is a side sectional view showing a state in which the electric wire-side connector is fit onto the first attachment.
Figure 20:
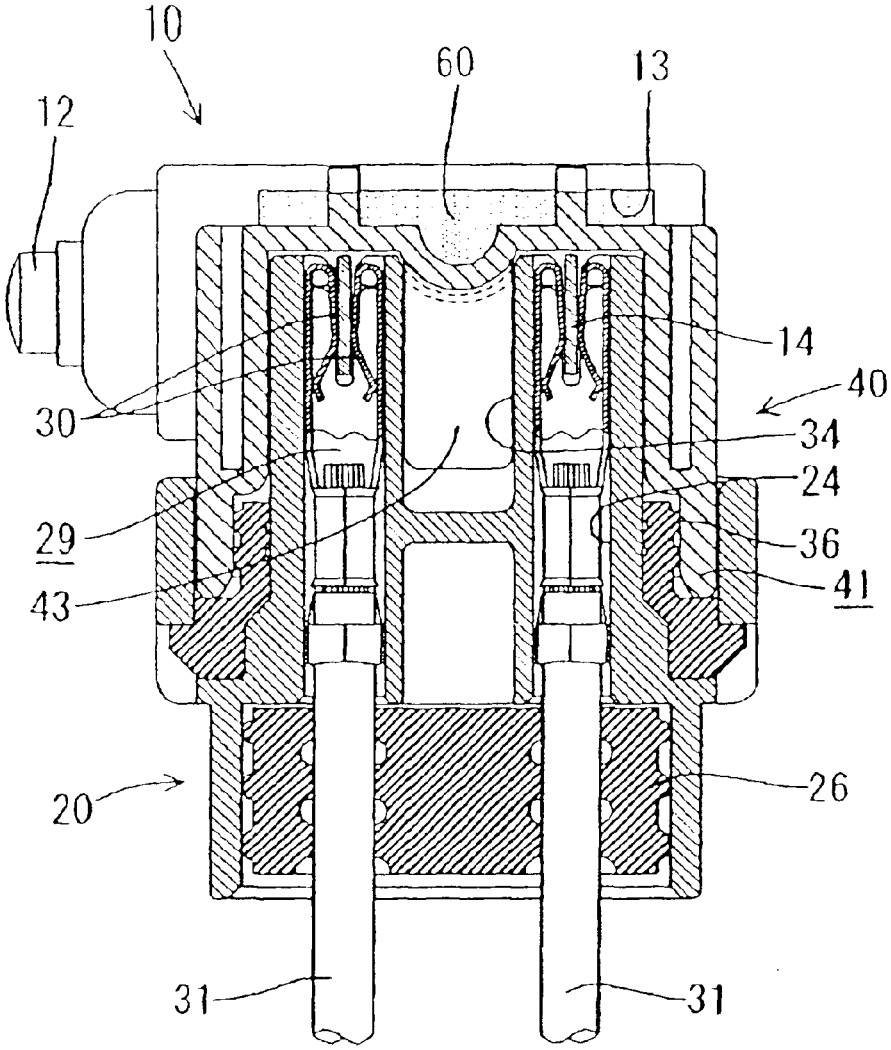
FIG. 20 is a plan sectional view showing the state in which the electric wire-side connector is fit onto the first attachment.

When the electric wire-side connector 20 is pressed into the normal position, as shown in FIG. 20, each switch terminal 14 is elastically sandwiched between a pair of the elastic contact pieces 30 of one of the corresponding connector terminals 29. Thus the switch terminals 14 and the connector terminals 29 contact each other, with the switch terminals 14 and the connector terminals 29 being orthogonal to each other. At this time, as shown in FIG. 19, the locking arm 38 is locked to the locking projection 49. Also, the electric wire 31 is directed out of the switch-side connector 10 in the direction orthogonal to the projected direction of the switch terminal 14. That is, relative to the switch-side connector, the electric wire 31 is wired and pulled out or directed in the shape of "L" from the switch-side connector 10.

When the electric wire 31 is desired to be pulled out or directed straight from the switch-side connector 10, the second attachment 50 is mounted on the switch-side connector 10. In this case, as shown by the arrows of FIGS. 10 and 11, the terminal insertion part 52 of the second attachment 50 is inserted into the mounting concavity 13. As shown in FIG. 22, the locking projection 57 is locked to the lower portion of the hooking part 15. The connector fit-on part 51 of the second attachment 50 is open and faces upward. A pair of the switch terminals 14 take a posture of facing upward from the bottom surface of the connector fit-on part 51 (as seen in FIGS. 10 and 11).

As shown by the arrow B of FIG. 14, the sealing material 60 is injected into the opening at the upper end of the guide cylinder 53 such that it flows into the mounting concavity 13 and the inlet passage 55. As shown in FIGS. 21 and 22, the projected portions of the switch terminals 14 are sealed with the solidified sealing material 60, and the second attachment 50 is firmly fixed to the switch-side connector 10.

After the second attachment 50 is fixed to the switch-side connector 10, as shown by the arrows of FIGS. 21 and 22, the electric wire-side connector 20 having the locking arm 38 formed on the upper surface thereof is fit onto the connector fit-on part 51, with the electric wire-side connector 20 facing downward. At this time, the tower part 22 is inserted straight into the connector fit-on part 51, with the tower part 22 being guided by fitting the guide cylinder 53 in the guide hole 34. With the progress of the insertion of the tower part 22 into the connector fit-on part 51, the switch terminals 14 penetrate into the vertical grooves 54 of the cavities 24 from the front side thereof and into a pair of the elastic contact pieces 30 of the connector terminals 29 accommodated in the cavities 24.

Figure 24:
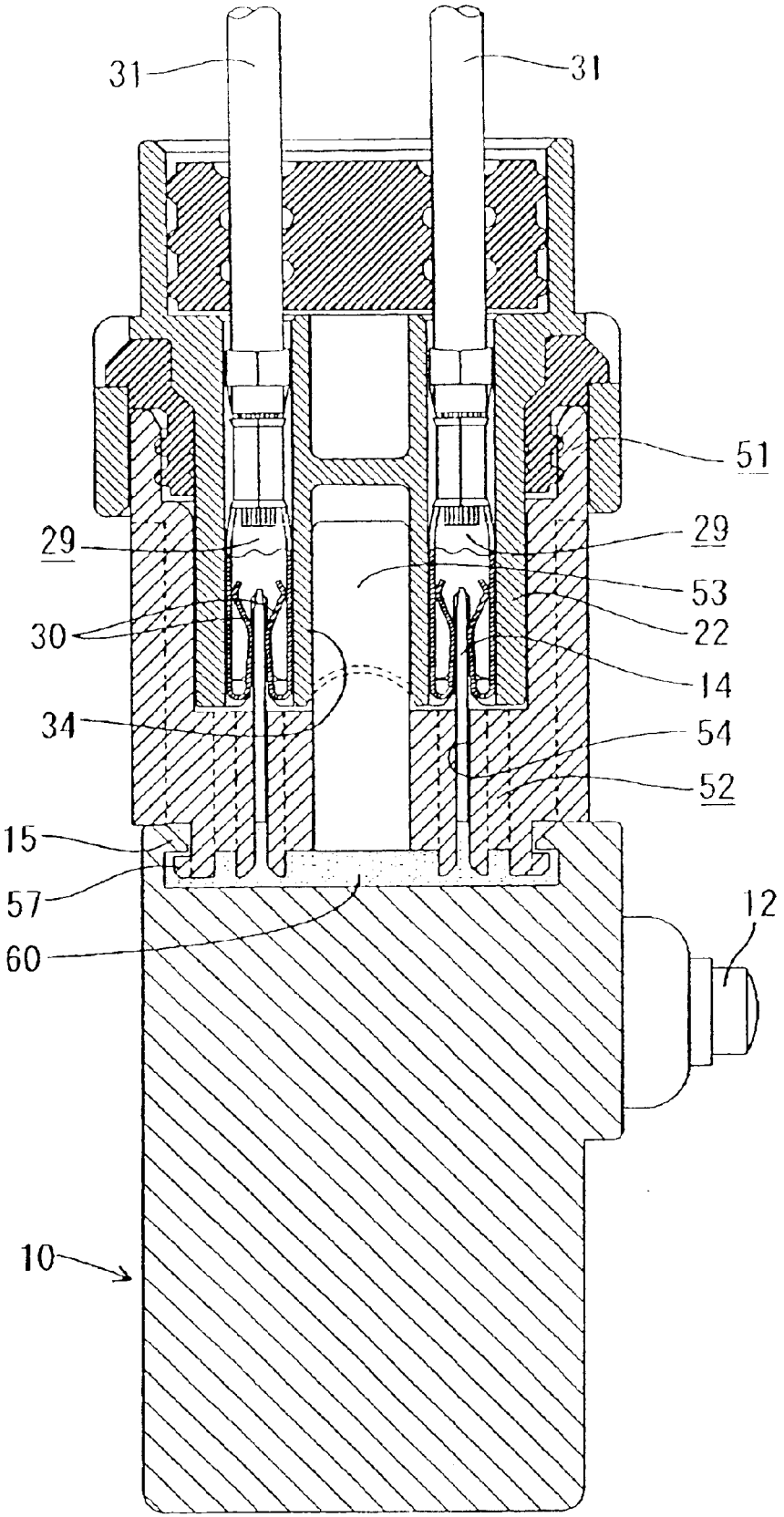
FIG. 24 is a rear sectional view showing the state in which the electric wire-side connector is fit onto the second attachment.

When the electric wire-side connector 20 is pressed into the normal position, as shown in FIG. 24, each switch terminal 14 is elastically sandwiched between a pair of the elastic contact pieces 30 of the corresponding connector terminal 29. Thus the switch terminals 14 and the connector terminals 29 contact each other, with the switch terminals 14 and the connector terminals 29 arranged in a row. At this time, as shown in FIG. 19, the locking arm 38 is locked to the locking projection 49. The electric wires 31 are thus pulled or directed out of the switch-side connector 10 in the same direction as the projected direction of the switch terminals 14. That is, the electric wires 31 are electrically coupled to and pulled out or directed straight from the switch-side connector 10.

As described above, in the embodiment, the first attachment 40 or the second attachment 50 are selectively mounted on the switch-side connector 10, and the electric wire-side connector 20 is fit onto the first attachment 40 or the second attachment 50. Thus the pull-out direction of the electric wires 31 can be easily altered from the L shape to the straight shape and vice versa.

Figure 25:
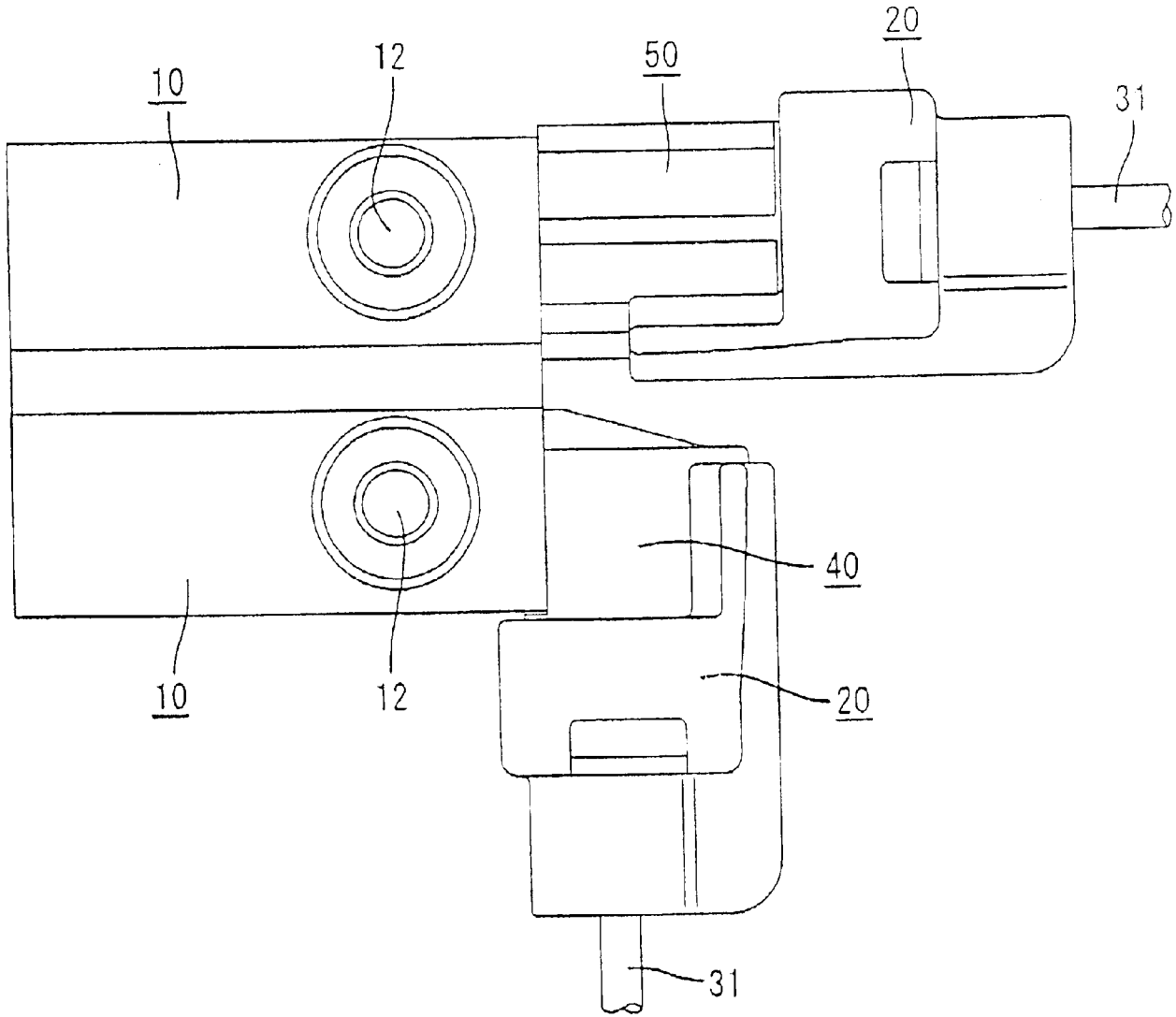
FIG. 25 is a side view showing a case in which switch-side connectors are superimposed on each other.

As shown in FIG. 25, in the case where a plurality of the switch-side connectors 10 are superimposed on each other, it is possible to effectively utilize the space by pulling or directing the electric wires 31 out of the switch-side connector 10 in the shape of an "L" and/or in a straight shape.

Other Embodiments

The technical scope of the present invention is not limited to the above description and the embodiment described above with reference to the drawings. For example, the following embodiments are included in the technical scope of the present invention. In addition to the following embodiments, the present invention can be embodied by modifying it without departing from the gist of the present invention.

(1) In the embodiment, the waterproof connector has been exemplified. However, the present invention is applicable to a non-waterproof connector.

(2) The present invention is applicable to not only the stop lamp switch exemplified in the above-described embodiment, but also a connector apparatus for other uses.

What is claimed is:

1. A connector apparatus for a switch comprising:

a switch-side connector having a switch mechanism and a switch terminal projecting therefrom;

an electric wire-side connector having a connector terminal connectable to said switch terminal and coupled to an electric wire;

a first attachment having a terminal insertion part into which said switch terminal can be inserted and a connector fit-on part connectable to said electric wire-side connector wherein said switch terminal is connected to the connector terminal, said connector fit-on part and said terminal insertion part being disposed approximately orthogonally to each other; and a second attachment having a terminal insertion part into which said switch terminal can be inserted and a connector fit-on part connectable to the electric wire-side connector wherein said switch terminal is connected to the connector terminal, said terminal insertion part and said connector fit-on part disposed in an approximately straight line, wherein said first attachment and said second attachment are interchangeably mounted on said switch-side connector.

2. A connector apparatus for a switch according to claim 1, wherein said switch-side connector can be provided in plural numbers in such a way that said switch-side connectors can be connected to each other.

3. A connector apparatus for a switch according to claim 1, further including sealing material between the terminal insertion part and the switch-side connector when connected thereto.

4. A connector apparatus for a switch according to claim 1, wherein the switch terminal has a free end, and the first attachment includes a groove for receiving the free end to hold the switch terminal for coupling with the connector terminal.

5. A connector apparatus for a switch according to claim 1, wherein the switch-side connector includes a concavity and hook parts about the concavity, and the terminal insertion part of each said first and second attachment includes complementary locking members to interchangeably secure the switch-side connector to the first and second attachments.

6. A connector apparatus for a switch according to claim 1, wherein each of the first and second attachments includes a guide positioned in the connector fit-on part to guide the fitting of the wire-side connector with either one of the first and second attachments.

7. A connector apparatus for a switch according to claim 6, wherein the switch-side connector includes a pair of switch terminals, and the guide is positioned between the switch terminals.

8. A connector apparatus for a switch according to claim 7, wherein the wire-side connector includes a pair of the connector terminals, each said connector terminal including a pair of opposed elastic pieces which receive one of the switch terminals therein.

* * * * *